US008668196B2

(12) United States Patent
Kostudis

(10) Patent No.: US 8,668,196 B2
(45) Date of Patent: Mar. 11, 2014

(54) DEVICE AND METHOD FOR STACKING SHEETS IN A PRINTING PRESS

(75) Inventor: Dimitrios Kostudis, Wedel (DE)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/525,587

(22) Filed: Jun. 18, 2012

(65) Prior Publication Data

US 2013/0001853 A1 Jan. 3, 2013

(30) Foreign Application Priority Data

Jun. 30, 2011 (DE) ..... 10 2011 106 171

(51) Int. Cl.
*B65H 29/70* (2006.01)

(52) U.S. Cl.
USPC ..... 271/188; 271/209

(58) Field of Classification Search
USPC ..... 271/188, 209
See application file for complete search history.

(56) References Cited

U.S. PATENT DOCUMENTS 6,503,011 B2 * 1/2003 Kono ..... 400/646
7,992,863 B2 * 8/2011 Jacobs et al. ..... 271/188
2010/0252989 A1 * 10/2010 Jacobs et al. ..... 271/272

FOREIGN PATENT DOCUMENTS

JP 04217549 A * 8/1992

* cited by examiner

*Primary Examiner* — Michael McCullough
(74) *Attorney, Agent, or Firm* — Roland R. Schindler, II

(57) ABSTRACT

A device and a method for the stacking of sheets in a printing press are disclosed. The device and correspondingly the method have at least two laterally spaced sheet transport roll pairs to transport the sheets in a transport plane. A stacking tray is furthermore provided to accommodate the sheets transported out of the printing press. A sheet contacting unit is arranged in the direction of transport behind the sheet transport roll pairs such that it deflects at least a partial region of the sheet out of the transport plane at least in a first direction, wherein the sheet undergoes a deformation transversely to the direction of transport, and wherein the at least two sheet transport roll pairs and the sheet contacting unit are arranged in a projection onto the transport plane in a triangular arrangement.

7 Claims, 4 Drawing Sheets

DEVICE AND METHOD FOR STACKING SHEETS IN A PRINTING PRESS

FIELD OF THE INVENTION

The present invention relates to a stiffening device and method for the stacking of sheets, in particular of long sheets in a printing press, and more particularly to an electrophotographic printing press with a plurality of printing units.

BACKGROUND OF THE INVENTION

During printing onto sheets, for example paper sheets, in particular during output of the printed sheets, the latter may be incorrectly stacked. Sheets that are not treated further, for example guiding or stiffening of the sheets, and are stacked out of the printing press on a stacking tablet, for example, can be kinked due to the inadequate rigidity of the paper sheets and thus will come to lie on the tray incorrectly, i.e., will be displaced or crossed over.

The above-described problem of kinking occurs in particular with long sheets, which if possible should not contact the stacking tray before they have almost fully left the printing press. The kinking results because the sheet cannot move freely on the stacking tray because part of it is still inside the printing press, and consequently a backlog may result.

In general, this incorrect stacking of sheets is prevented by deformation of the sheets in a particular manner, so that the sheet is stiffened as a result of this deformation. As a result it is possible for the sheet after leaving the printing press to remain free of kinks and for it to be guided out of the press with a substantially constant alignment, and after completely leaving the press to be stacked on the stacking tray in a controlled manner.

A person skilled in the art will be familiar with systems, so-called stiffeners, which bring about a stiffening of printed sheets to be output. Transport roll pairs, located in one plane and arranged with lateral displacement, are for example provided for this, having for example complimentary-shaped ball-shaped and spindle-shaped rolls. This design of the rolls results in the sheets to be output being deformed at different points in the region of the transport roll pairs, i.e., locally deflected out of a transport plane in which the sheet was previously transported so that a type of wave surface is formed. The sheet can be stiffened as a result and be stacked on the stacking tray after leaving the printing press without kinking. With this known system, the transport roll pair assumes the functions of both transport and stiffening.

A drawback of stiffening of sheets in this way is the formation of artifacts, such as pressure points and/or a smudging of the printed content as a result of the tightly-limited deformation in the region of the transport rolls. With long sheets or very light sheets in particular, a substantial deformation of the sheet is necessary to obtain the required stiffness, as a result of which the sheet does not kink before it is laid on the stacking tray. With a device as described above, an increase in deformation would lead to an increase in the described artifacts.

Starting from the above-described situation, it is therefore an object of the present invention to provide a controlled stacking of a sheet such that there is no deterioration of the printed content of a previously applied print medium and no damage in any way to a sheet due to its being placed on a stacking tray, for example through pressure points on the sheet.

SUMMARY OF THE INVENTION

In particular a stiffening device is provided for the stacking of sheets in a printing press that has at least two sheet transport roll pairs, laterally at a distance from each other, to transport the sheet in a transport plane. Furthermore, a stacking tray to accommodate a sheet transported out of the printing press and a sheet contacting unit which is arranged in the direction of transport behind the sheet transport roll pairs such that it deflects at least a partial area of the sheet out of the transport plane in at least one first direction, with the sheet undergoing a deformation transversely to the direction of transport, and with the at least two sheet transport roll pairs and the sheet contacting unit during projection in the transport plane being arranged in a triangular arrangement. A device of this type enables the sheet to be placed on the stacking tray in a controlled manner, since due to the deformation of the sheet the latter is stiffened in such a way that it cannot be kinked before completely leaving an output area of the sheet. Controlled deposition of the sheet in this way furthermore has the advantage that there is no need for additional work steps, for example, alignment of a plurality of sheets laid on the stacking tray, so that a stack of sheets can, for example, be directly packed.

In accordance with a design example, at least two further roll pairs are disposed in the direction of transport of the sheet behind the sheet contacting unit, with the axes of the further roll pairs being arranged at an angle to the transport plane transversely to one direction of transport. An arrangement of this type can be an advantage, for example with the use of very thick sheets, since the deformation of the sheet is here achieved over a greater contact region between the obliquely-inclined roll pairs, which bring about the deformation of the sheet, and the sheet itself.

A device is furthermore provided having further sheet contacting units which deflect the sheet against the first direction in a second direction. The provision of a plurality of sheet contacting units can be advantageous, for example with very light sheets, since a deformation of the sheet at a number of points can be achieved here.

In a preferred design example, the sheet contacting unit can be arranged centrally between the sheet transport roll pairs. Moreover, the sheet contacting unit can have a fixed contact dome with a sliding surface, which facilitates sliding of the sheet over the sheet contacting unit and thereby prevents a backlog of sheets. Furthermore, the sheet contacting unit can be a roll, which similarly promotes sliding of the sheet over the sheet contacting unit. It is pointed out here again that with this design example too, in contrast to common systems, the region in which the sheet is transported, for example by transport rolls, and the region in which the sheet undergoes a deformation are apart from one another.

In a further embodiment of the device in accordance with the invention, the sheet contacting unit can be designed as a wedge which increasingly deflects the sheet out of the transport plane in the direction of transport. The wedge can be arranged such that a sheet that is being guided out of the printing press moves in the direction of the wedge-shaped sheet contacting unit and after contacting said sheet contacting unit is increasingly deflected. This has the advantage that when the sheet reaches the sheet contacting unit an uncontrolled impact of the sheet against the sheet contacting unit can be avoided.

In a further embodiment, the mean distance of the projection onto the transport plane of sheet contact regions of the sheet transport roll pairs to a sheet contact region of the sheet contacting unit is variable. This means that the region within which the sheet contacting unit contacts the sheet can be changed in its distance from the sheet transport roll pairs, which for example can be advantageous with very long and/or very light sheets, since it allows premature kinking of the sheet due to its length and/or its weight to be avoided.

In one embodiment, the position of the sheet contact region of the sheet contacting unit can be varied relative to the transport plane in the vertical direction. It can be ensured by such an embodiment that the degree of deformation of the sheet is sufficient to prevent premature kinking of the sheet during discharge from the printing press. A lowering or a raising, depending upon whether the sheet contacting unit contacts the sheet from above or below, results in a greater deformation of the sheet and thus to a higher degree of stiffness.

In a further embodiment, the sheet transport roll pairs are arranged so that the transport plane is inclined to the horizontal such that the sheets are conveyed obliquely downwards. This means that the tangential plane, which abuts contact points of the sheet transport roll pairs (it is to be noted here the sheet transport roll pairs do not contact each other directly, but contact takes place via the sheet to be transported between them), is inclined towards the ground in the direction of transport. The transport plane can however also be aligned with the horizontal or be inclined relative to the horizontal such that the sheets are conveyed obliquely upwards. An arrangement in which the sheets are conveyed obliquely downwards can in particular be advantageous if the sheet contacting unit contacts the sheet from below. As a result, as soon as the sheet leaves the sheet transport roll pairs, a transport of the sheet beyond the sheet contacting unit can be ensured due to the intrinsic weight of the sheet.

The stiffening device can furthermore have a control unit that is suitable for the control of the sheet contacting unit. Using the control unit, the sheet contacting unit can, as described above, be varied both in its distance to the sheet transport roll pairs and in its vertical position relative to the transport plane. The control unit is here suitable to determine at least one sheet parameter. Sheet parameters can here be the thickness of the sheet, the weight, the length or other parameters which can influence the deformation of the sheet. The control unit can furthermore be suitable to set the position of the contact point of the sheet contacting unit as a function of at least one sheet parameter. With an embodiment of this type, an automatic adjustment of the sheet contacting unit position can thus take place, depending on the sheet used.

Furthermore, a method is provided for stacking sheets in a printing press is provided, with a sheet beings transported by at least two sheet transport roll pairs, laterally at a distance from one another, which contact the sheet in at least two different regions and convey the sheet in a transport plane out of the printing press. Furthermore, the sheet is guided along a sheet contacting unit, with the sheet contacting unit deflecting the sheet at least in a partial region of the sheet out of the transport plane in a first direction, with the sheet undergoing a deformation transversely to the direction of transport, and with the sheet transport roll pairs and sheet contacting unit contacting the sheet in different regions such that the regions have a triangular arrangement in a projection onto the transport plane. A method of this type enables the above-mentioned advantages to be achieved.

In a further design example, the method can be characterized in that the sheet can be deflected out of the transport plane by at least two further roll pairs, the axes of which are at an angle to the transport plane transversely to the direction of transport and which are arranged in the direction of transport behind the sheet contacting unit, such that the sheet undergoes a deformation transversely to the direction of transport. In addition, the method can be implemented so that the sheet is deflected by further sheet contacting units out of the transport plane, such that the sheet is deflected against the first direction in a second direction.

DETAILED DESCRIPTION OF THE INVENTION

Figure 1:
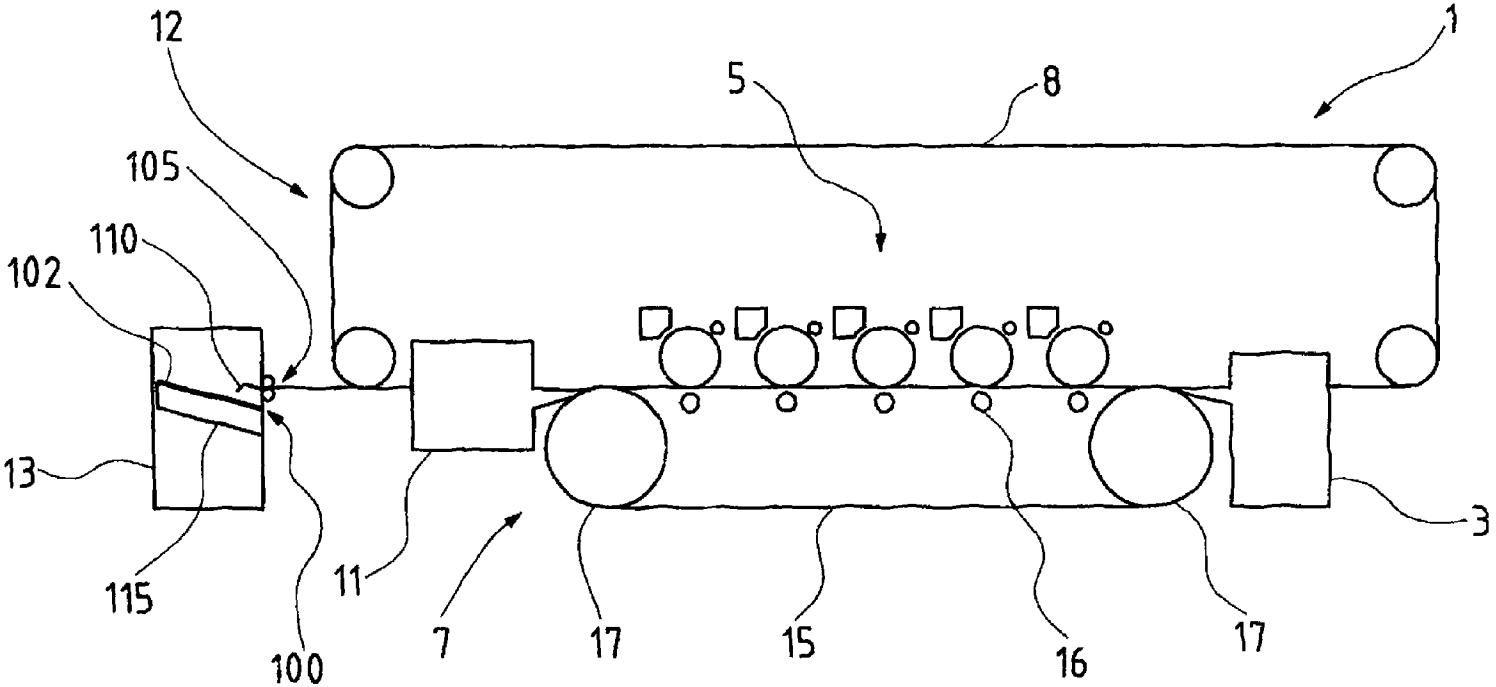
FIG. 1 is a schematic side view of a multicolor printing press.

In the following description, the position and direction information refers primarily to the representations in the drawings and should therefore not be regarded as restrictive. They can however also refer to a preferred final arrangement.

*Fig.* 1 shows a schematic side view of a multicolor printing press 1 with a feeder 3, a plurality of printing units 5, a transport unit 7, a fixing unit 11 for fixing a print medium onto a substrate, a duplex path 12, a delivery arm 13 with a stiffening device 100 and with a stacking tray 115. Multi-color printing presses of this type are known in a wide variety of embodiments, and FIG. 1 represents only a very simplified example thereof.

The feeder 3 serves to accommodate a sheet stack and to feed individual sheets to the transport unit 7, and is shown positioned at a first end of the printing press 1. It can however also be arranged at any other desired position and does not have to feed the sheets 102 directly to the transport unit 7, but can instead feed them to a transport path which then delivers the sheets 102, for example via an alignment unit, to the transport unit 7, which is described in more detail below and transports the sheets 102 past the printing units 5.

The printing units 5 are of a suitable type to print color separations onto sheets 102 transported by the transport unit 7. In the multicolor printing press 1 shown, five printing units 5 are shown, which can be operated for example with the colors black, cyan, magenta, yellow and a special color, such as Clear DryInk. The printing units 5 are represented as electrophotographic printing units which are arranged above the transport unit 7.

The transport unit 7 comprises, in a known way, a conveyor belt 15, which is guided circumferentially around appropriate guiding and/or driving pulleys 17 in order to provide a closed transport path. In the region of the printing units 5, pressure rolls 16 are provided which press the transport belt 15 and any sheets 102 present thereon against an image transfer roller of the electrophotographic printing units.

The fixing unit 11 is arranged at that end of the transport unit 7 away from the feeder 3, in the direction of rotation of the transport belt 15 downstream relative to the printing units 5. The fixing unit 11 possesses a mechanism, not shown in detail here, to take up printed sheets 102 from the transport belt 15 and to transport them through it. Suitable means are provided in the fixing unit 11 for fixing of toner applied by one of the electrophotographic printing units.

A switching means, not shown in detail, is provided in the direction of movement of the sheets behind the fixing unit and sends sheets 102 either to the duplex path 12 or the delivery arm 13 with the stiffening device 100 which serves to accommodate printed sheets 102. The stiffening device 100 here brings about a deformation of the sheet 102 to achieve controlled stacking of the sheet 102.

The duplex path 12 has suitable transport means to transport a sheet 102, which has been printed on one side, for example, back to the transport unit 7 and to turn it in the course thereof, for printing of the second side. To do so, the duplex path 12 defines a transport path 8 which, commencing behind the fixing unit 11 above the printing units 5 extends back to a stacking region of the transport unit 7. A turning unit, not shown in detail, is provided along the transport path and turns the sheet during transport so that it is stacked with the unprinted side facing upwards at the transport unit. With this arrangement of the duplex path 12, it is possible for a sheet, after printing of a first side and after fixing by toner in a fixing unit 11, to be conveyed back to the transport unit 7 so that the second side of the sheet can be printed.

The delivery arm 13 comprises, as shown in FIG. 1, the stiffening device 100, the stacking tray 115 and the sheet transport roll pairs 105. The stacking tray 115 is here arranged inclined, so that a defined stacking of the sheets to be stacked can be achieved. The sheet transport roll pairs 105 are arranged above the stacking tray 115 such that they can hold a sheet transported to the delivery arm 13 and transport it to the stiffening device 100. The stiffening device 100 is arranged in the direction of transport behind the sheet transport rolls 105. The stiffening device 100 is arranged such that a sheet transported through the transport roll pairs is locally deflected out of a transport plane upwards or downwards depending on how the stiffening device 100 is arranged. The transport plane is defined by the arrangement of the sheet transport roll pairs, i.e., by the tangential plane that results from the opposite sheet transport rolls.

Figure 2:
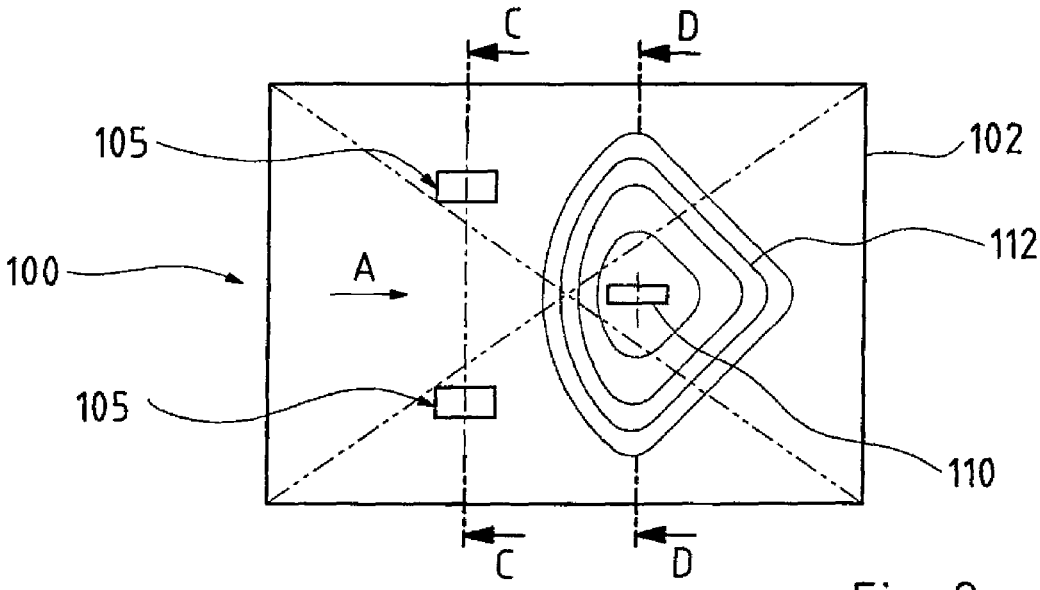
FIG. 2 is a plane view of a first design example of a stiffening device in accordance with the invention for a sheet.

The structure and mode of operation of the stiffening device 100 are described in more detail below with reference to FIGS. 2 to 8. FIG. 2 shows a schematic plan view of the stiffening device 100 with a schematically indicated sheet contacting unit 110, sheet transport roll pairs 105, as well as a region 112 representing a deformation region of the sheet 102.

FIG. 2 furthermore shows the direction of sheet transport by the arrow A. It can also be seen from FIG. 2 that the sheet transport roll pairs 105 and the sheet contacting unit 110 are spatially separated from one another such that they (in the plane view) form a triangular arrangement. As a result, the deformation region 112 extends over a large area of the sheet to be deformed 102. In particular, the sheet deformation stresses generated by the sheet contacting unit are separated from the transport forces generated by the transport rolls to avoid imprinting of the sheets. The sheet contacting unit 110 here acts from above on the sheet 102, as described in more detail below for FIG. 4. The sheet contacting unit 110 can here have a wedge shape not shown in the Figures to make it easier for the sheet to mount the sheet contacting unit 110, so that the sheet is thus increasingly deformed.

The sheet contacting unit 110 can however deflect the sheet 102 out of the transport plane from below.

With an arrangement of this type, it must be noted that the entire arrangement is aligned such that a sheet 102 is guided so far over the sheet contacting unit 110 that it does not remain on the sheet contacting unit 110 or is prevented by the latter from being stacked in a controlled manner on the stacking tray 115.

The stiffening device 100 is described below in the manner that the sheet contacting unit 110 acts from above on the sheet 102.

The sheet contacting unit 110 can have a sliding surface, not shown in detail here, on which the sheet 102 slides over the sheet contacting unit 110. Depending on various sheet parameters such as the thickness of the sheet 102, the length of the sheet 102 or the rigidity of the sheet 102, a distance between the section lines C and D, i.e., the distance in the direction of transport between the sheet transport roll pairs 105 and the sheet contacting unit 110, can be varied.

In so far as the sheet transport roll pairs 105 are not on one axis, i.e. they are at a distance not only laterally, i.e., transversely to the direction of transport A, but also longitudinally, i.e. in the direction of the direction of transport, a mean distance between the sheet contacting unit 110 and the sheet transport roll pairs 105 can be defined, and is obtained from the mean distance between the sheet transport roll pairs 105 in the direction of transport A and the line D in FIG. 2.

It must be noted here that the distance is markedly lower than the length of the shortest sheet 102 to be stacked. Furthermore, the vertical position of the sheet contacting unit 110 can be changed relative to the sheet transport plane, allowing a greater or lesser deformation of the sheet 102, which is similarly dependent on the aforementioned sheet parameters and thus enables an adaptive matching to the sheets 102 used.

A suspension, not described in detail, of the sheet contacting unit 110 should be designed such that a change in position of the sheet contacting unit 110 is possible both in the direction of transport of the sheet 102 and in a vertical direction relative to the transport plane, as described above.

The sheet transport roll pairs 105 are arranged at a distance from the side, relative to the direction of sheet transport A, as can be readily seen in FIG. 2. Regions in which the sheet transport roll pairs 105 and the sheet contacting unit 110 are arranged and which contact the sheets 102 here form a triangular arrangement in the projection onto the transport plane of the sheet 102.

It must be noted here that the regions in which the sheet 102 is transported by the sheet transport roll pairs 105 and the region 112 in which the sheet 102 is deformed are spatially separate from one another. The sheet transport roll pairs 105 can here be arranged on common axes so that two rolls contact the sheets 102 from above and two further rolls contact the sheets 102 from below, as can readily be seen in FIG. 3.

The stiffening device 100 furthermore has a device, not shown in detail, which enables a change of the sheet contacting unit 110 relative to the transport plane both in the direction of transport A of the sheet and in a vertical direction. The stiffening device 100 furthermore has a control unit which adjusts the position of the sheet contacting unit 110 as a function of sheet parameters determined by the control unit.

Figure 3:
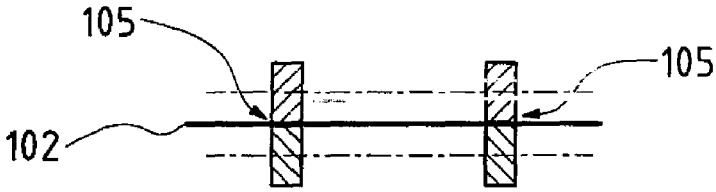
FIG. 3 is a sectional representation along the section line C-C from FIG. 2.

FIG. 3 shows, as mentioned above, a sectional representation along the section line C-C in FIG. 2, with the sheet 102 in this representation being in the transport plane. It can be readily seen in FIG. 3 how the sheet transport roll pairs 105 contact the sheet 102 from below or from above and thereby enable transport of the sheet 102 in the direction of transport A to the sheet contacting unit 110.

Figure 4:
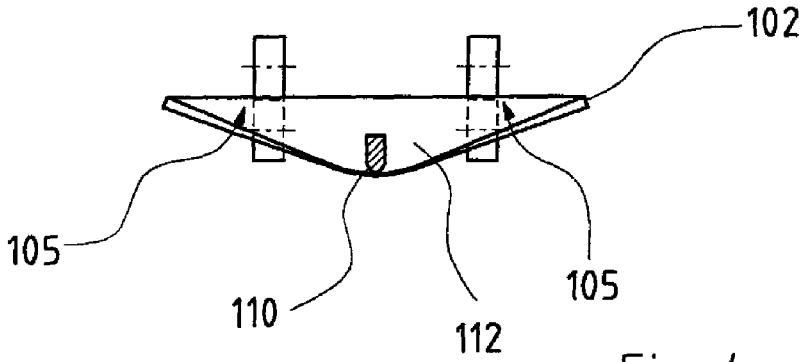
FIG. 4 is a sectional representation along the section line D-D from FIG. 2.

FIG. 4 shows a sectional representation of the arrangement in FIG. 2 along the section line D-D, with the sheet contacting unit 110 contacting the sheet 102 from above so that a deformation of the sheet 102 results, as shown in FIG. 4. The sheet transport roll pairs 105 can be recognized in the background, and the deformation region 112, in the form of a triangle, is recognizable in the foreground. The stiffening of the sheet 102 achieved by the deformation of the sheet 102 enables a controlled stacking of the sheet 102 on the stacking tray 115 as soon as the sheet 102 has left the sheet transport roll pairs 105.

In this representation, it can be readily seen that a vertical displacement of the sheet contacting unit 110 relative to the transport plane allows a greater or lesser deformation of the sheet 102 to be achieved.

The contact surfaces of the sheet transport roll pairs 105 and of the sheet contacting unit 110 on the sheet 102 also form in the sectional view according to FIG. 4 (transversely to the direction of transport) a triangular arrangement with the contact surfaces as the corner points. In particular, the sheet contacting unit 110 is arranged such that it contacts a sheet 102 from above and deflects it below the transport plane, i.e., the sheet contacting unit 110 is displaced relative to the transport plane in the direction of the floor.

As mentioned above, an arrangement can also be chosen in which the sheet contacting unit 110 contacts the sheet 102 from below. The sheet contacting unit here causes the sheet to be deflected upwards relative to the transport plane. The sheet contacting unit 110 and the sheet transport roll pairs 105 form as well a triangular arrangement with this type of arrangement both in the plan view according to FIG. 2 and in the sectional view according to FIG. 4. With this arrangement, it can be particularly advantageous if the transport plane commencing from the sheet transport roll pairs 105 declines obliquely downwards. The inclination of the transport plane here promotes sliding of the sheet 102 over the sheet contacting unit 110 once it has been released from the sheet transport roll pairs 105.

Figure 5:
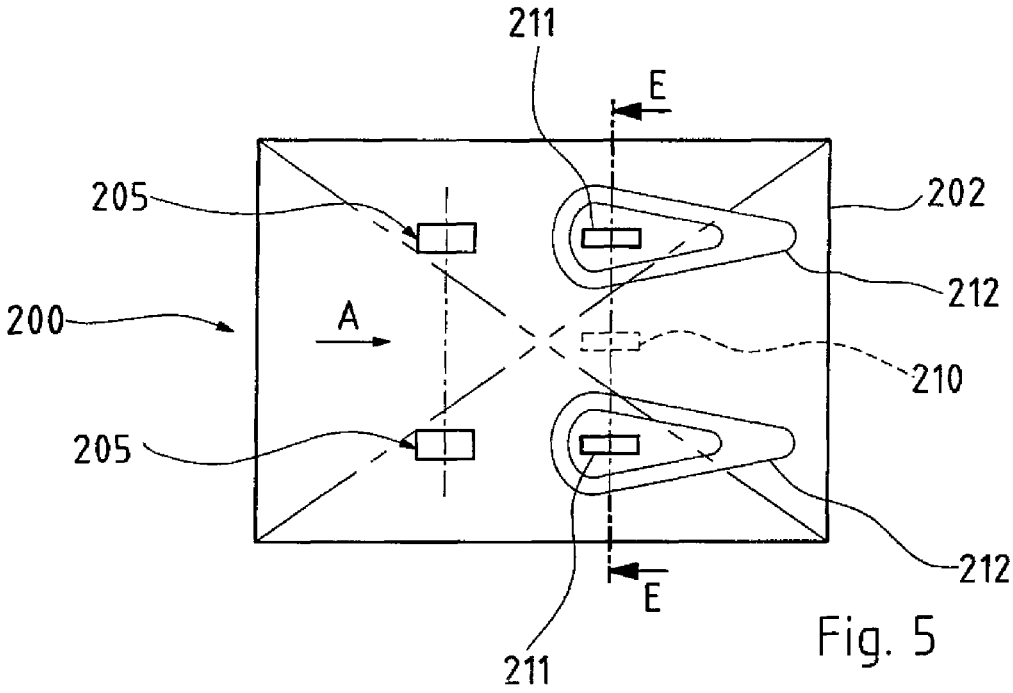
FIG. 5 is a plane view of a second design example of a stiffening device in accordance with the invention for a sheet.

A further design example is shown in FIG. 5, with a stiffening device 200 being represented with which a sheet 202 is transported by sheet transport roll pairs 205 in a direction of transport A. In this design example, a sheet contacting unit 210 and two sheet contacting units 211 are arranged along the line E-E. The arrangement of the sheet contacting units 210, 211 is chosen symmetrical here, but other distances can be provided between the sheet contacting units 210 and 211. The sheet contacting units 211 in this design example are arranged such that they contact the sheet 202 from above and in the process deflect it out of the transport plane. In addition, the sheet contacting unit 210 is arranged such that it contacts the sheet 202 from below in such a way that it deflects the sheet 202 against the deflection through the sheet contacting units 211.

Figure 6:
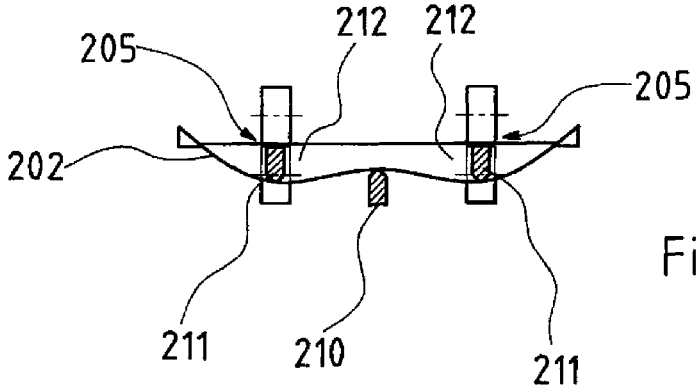
FIG. 6 is a sectional representation along the section line E-E from FIG. 5.

This results in a wave structure within the sheet 202, which can be readily seen in FIG. 6. Two deformation regions 212 develop on the sheet 202, as shown in FIG. 5. It must be noted here too that the deformation regions of the sheet 202 are spatially separate from the sheet transport roll pairs 205. Depending on the arrangement of the sheet contacting units 210 and 211, an inclination of the transport plane can support transport of the sheet 202 beyond the sheet contacting units 210, 211, with this being dependent on the overall geometry and the sheet parameters.

As described for the above design example, in this design example too a control device can be provided which can change the position of the sheet contacting units 210, 211 both in the direction of transport A, as well as perpendicularly to the transport plane. This can similarly lead, as described above, to a change in the deformation regions 212, i.e., the regions 212 can be increased or decreased in size depending on the position of the sheet contacting units 210, 211, as a function of the above-mentioned sheet parameters.

Figure 7:
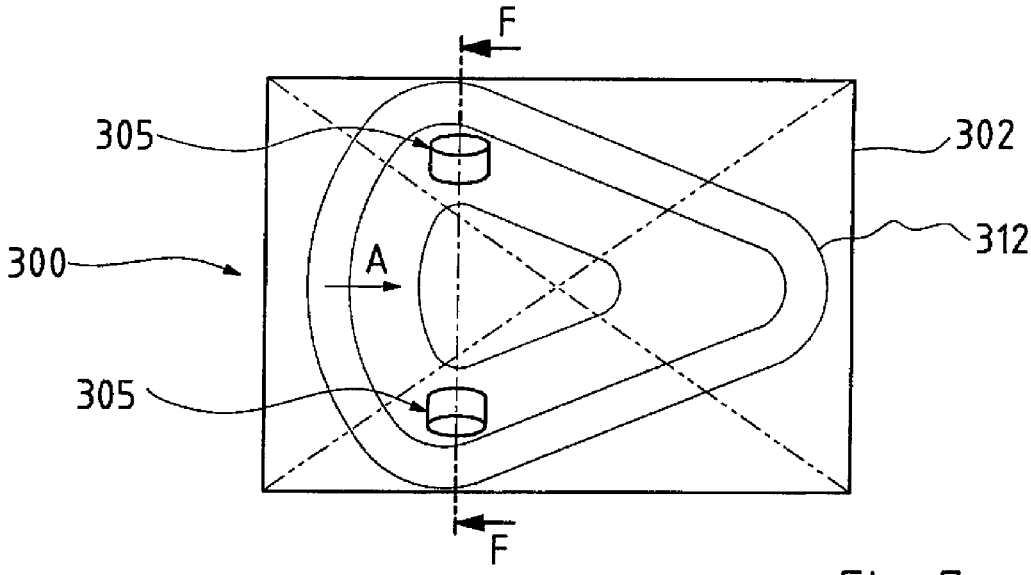
FIG. 7 is a plane view of a third design example of a stiffening device in accordance with the invention for a sheet.

A further design example of a stiffening device 300 is shown in FIG. 7. The stiffening device 300 shown in FIG. 7 is positioned behind a stiffening device 100, as shown in FIG. 1, i.e., the stiffening device 300 lies in the direction of transport A behind the stiffening device 100. In this design example, sheet transport roll pairs 305 are provided as well, but have axes that are at an angle relative to the transport plane.

The inclined sheet transport roll pairs 305 bring about a further stiffening of the sheet 302 and form a deformation region 312 on the sheet 302.

Figure 8:
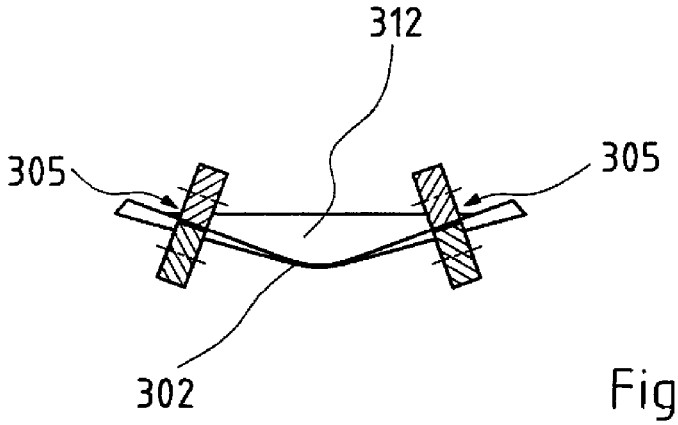
FIG. 8 is a sectional representation along the section line F-F from FIG. 7.

The sheet transport roll pairs 305 are shown in FIG. 8 such that the sheet 302 is deflected in a downward direction, as a result of which the deformation region 312 extends downwards away from the transport plane. However, the sheet transport roll pairs 305 can also be arranged such that they are inclined obliquely outwards, i.e., bring about a deformation of the sheet 302 upwards relative to the transport plane. To make insertion of a sheet between the sheet transport roll pairs 305 easier, a sheet contacting unit can be provided in the direction of transport in front of the sheet transport roll pairs 305, which at least partially deforms the sheet in advance. It would also be possible to provide a plurality of sheet transport roll pairs 305 that have a successively greater inclined position in the direction of transport.

The operation of the printing press and in particular the stiffening device 100 is described below with reference to the Figures. A sheet 102 to be printed on is first transferred from the feeder 3 to the transport belt 15 where it is electrostatically fixed, for example. The transport belt conveys the sheet 102 past the printing units 5 in which individual color separations of a toner image are respectively applied to the sheet 102 to create a multicolor toner image on the sheet 102.

The sheet 102 with the toner image on it is then transferred to the fixing unit 11.

Once the sheet 102 reaches the duplex path 12, it is conveyed back to the transport unit 7 and on the way there is turned so that the sheet 102 is transferred in such a way that the previously printed side faces the transport belt 15. The second side of the sheet 102 is now printed on by the printing units 5 and the sheet 102 printed in this way is then transferred to the fixing unit 11. After fixing of the toner on the second side of the sheet 102, it is then conveyed to the stiffening device 100 in which the sheet 102 is contacted using the sheet transport roll pairs 105 and a sheet contacting unit 110 such that the sheet 102 is deformed and consequently stiffened to bring about controlled stacking on the stacking tray.

The invention has been described above on the basis of concrete embodiments without being limited to these. In particular, it should be pointed out that the embodiments can be freely combined with one another, and individual elements of the different embodiments are interchangeable if required in so far as they are compatible.

In particular, the stiffening device can be used in combination with printing presses other than the one shown.

The invention has been described in detail with particular reference to certain preferred embodiments thereof, but it will be understood that variations and modifications can be effected within the spirit and scope of the invention.

What is claimed is:

1. A stiffening device for the stacking of sheets in a printing press, said device comprising:

at least two laterally distanced sheet transport roll pairs for transporting a sheet in a transport plane;

a stacking tray to hold the sheets conveyed out of the printing press; and a sheet contacting unit which is arranged in a direction of transport behind the sheet transport roll pairs such that it deflects at least a partial region of the sheet out of the transport plane at least in a first direction, wherein the sheet undergoes a deformation transversely to the direction of transport and wherein the at least two sheet transport roll pairs and the sheet contacting unit during projection in the transport plane are arranged in a triangular arrangement, and wherein at least two further roll pairs are arranged in the direction of transport of the sheet behind the sheet contacting unit, wherein axes of the further roll pairs are arranged at an angle to the transport plane transversely to the direction of transport.

2. The stiffening device according to claim 1, wherein the device has further sheet contacting units which deflect the sheet against the first direction in a second direction.

3. The stiffening device according to claim 1, wherein the sheet contacting unit is arranged centrally between the sheet transport roll pairs.

4. The stiffening device according to claim 1, wherein a mean average distance of the projection onto the transport plane of sheet contact regions of the sheet transport roll pairs to a sheet contact region of the sheet contacting unit is variable.

5. The stiffening device according to claim 1, wherein a position of the sheet contact region of the sheet contacting unit relative to the transport plane is variable in a vertical direction.

6. A method for the stacking of sheets in a printing press, the method comprising:

transporting a sheet by means of at least two laterally spaced sheet transport roll pairs that contact the sheet in at least two different regions and convey the sheet in a transport plane out of the printing press;

guiding the sheet along a sheet contacting unit, wherein the sheet contacting unit deflects the sheet in at least one partial region of the sheet out of the transport plane in a first direction, wherein the sheet undergoes a deformation transversely to a direction of transport, and wherein the sheet transport roll pairs and the sheet contacting unit contact the sheet in different regions such that the regions during projection onto the transport plane have a triangular arrangement; and wherein the sheet is deflected out of the transport plane by at least two further roll pairs, axes of which are at an angle to the transport plane transversely to the direction of transport and which are arranged in the direction of transport behind the sheet contacting unit, such that the sheet undergoes a deformation transversely to the direction of transport.

7. The method according to claim 6, wherein the sheet is deflected out of the transport plane by further sheet contacting units and in such a way that the sheet is deflected against the first direction in a second direction.

* * * * *